US005784785A

United States Patent [19]

Polites

[11] Patent Number: 5,784,785

[45] Date of Patent: Jul. 28, 1998

[54] FOLDING LONGITUDINAL RAZOR

[75] Inventor: Alexandra Polites, New York, N.Y.

[73] Assignee: Violex-Bic, S.A., Greece

[21] Appl. No.: 871,070

[22] Filed: Jun. 9, 1997

[51] Int. Cl.[6] ..... B26B 21/10

[52] U.S. Cl. ..... 30/53; 30/528

[58] Field of Search ..... 30/53–59, 527, 30/528, 47, 155, 331; D28/45, 48

[56] References Cited

U.S. PATENT DOCUMENTS

| | | | |
|---|---|---|---|
| D. 248,878 | 8/1978 | Halm | D28/48 |
| D. 357,767 | 4/1995 | Schwarz | D28/45 |
| 5,009,003 | 4/1991 | Grange | 30/528 X |
| 5,206,994 | 5/1993 | Lin | 30/47 |
| 5,649,364 | 7/1997 | Ilanlou | 30/528 X |

*Primary Examiner*—Douglas D. Watts

*Attorney, Agent, or Firm*—Baker & Botts, L.L.P.

[57] ABSTRACT

A folding disposable razor includes a shaving head which folds into the razor handle and is aligned with the handle when in an open or extended position.

5 Claims, 7 Drawing Sheets

FOLDING LONGITUDINAL RAZOR

BACKGROUND OF THE INVENTION

This invention relates to a razor which includes a shaving head which can be folded into and stored in the razor handle and which allows for bidirectional shaving.

Conventional razors include a handle with a shaving head affixed perpendicularly to the handle in a "T" shaped configuration. These conventional razors usually require a separate cover piece to protect the user from accidental cuts when the razor is not in use. This additional cover piece is inconvenient to keep track of for the user, and complicates the manufacturing process. In addition, these razors are not conveniently transported while traveling.

A razor having a T-shaped configuration may also be difficult to manipulate when used on skin areas which are contoured or narrow and typically does not allow for bidirectional shaving.

SUMMARY OF THE INVENTION

Accordingly, it is an object of the invention to provide a razor having a shaving head which folds into the body of the razor when not in use.

Another object of the invention is to provide a razor which is conveniently and safely transported.

A further object of the invention is to provide a razor which is easy to manufacture, ergonomic and allows for bidirectional shaving.

These and other objects of the subject invention are attained by providing a razor having a hollow handle including a plurality of axially spaced apertures along each side of the handle. The handle has a first recess on one side for receiving a shaving head which is pivotally attached to the top end of the razor handle. The shaving head includes a projection or lip which extends axially above the pivot point on the top end of the razor handle. The handle also includes a second recess on the side opposite from the side of the handle including the first recess. Upon application of force to the lip portion, the shaving head pivots about the top of the handle and the lip portion is engaged in the second recess in the razor handle.

Alternating slots are placed along the length of the handle. The wall portions on each side are directly opposite the apertures on the opposite side. This design facilitates and reduces the cost of manufacturing of the razor handle. In addition, this handle design helps prevent slippage when wet shaving.

BRIEF DESCRIPTION OF THE DRAWINGS

Further objects and advantages of the present invention will be more fully appreciated from a reading of the detailed description when considered with the accompanying drawings wherein.

DETAILED DESCRIPTION OF THE PREFERRED EMBODIMENTS

Figure 1:
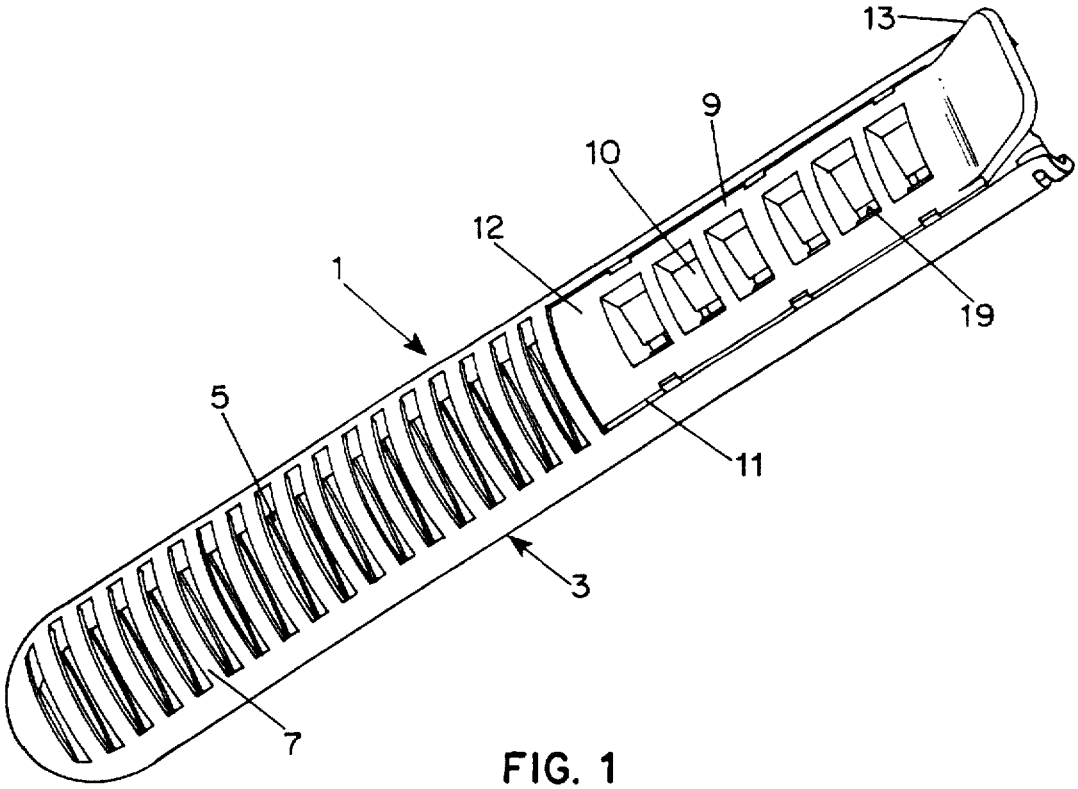
FIG. 1 is a front view of a razor in accordance with the invention.

Referring to FIG. 1, a razor 1 in accordance with the invention includes a hollow handle 3 having a plurality of apertures 5. The apertures 5 on opposite sides of the hollow handle 3 are axially displaced with respect to one another. Accordingly, an aperture 5 faces a rib 7 or solid portion of the opposite side of the handle. A shaving head 9 folds into a recess 11 on one side of the razor handle 3. A lip or projection 13 extends at an angle from the top portion of the shaving head 9.

Figure 2:
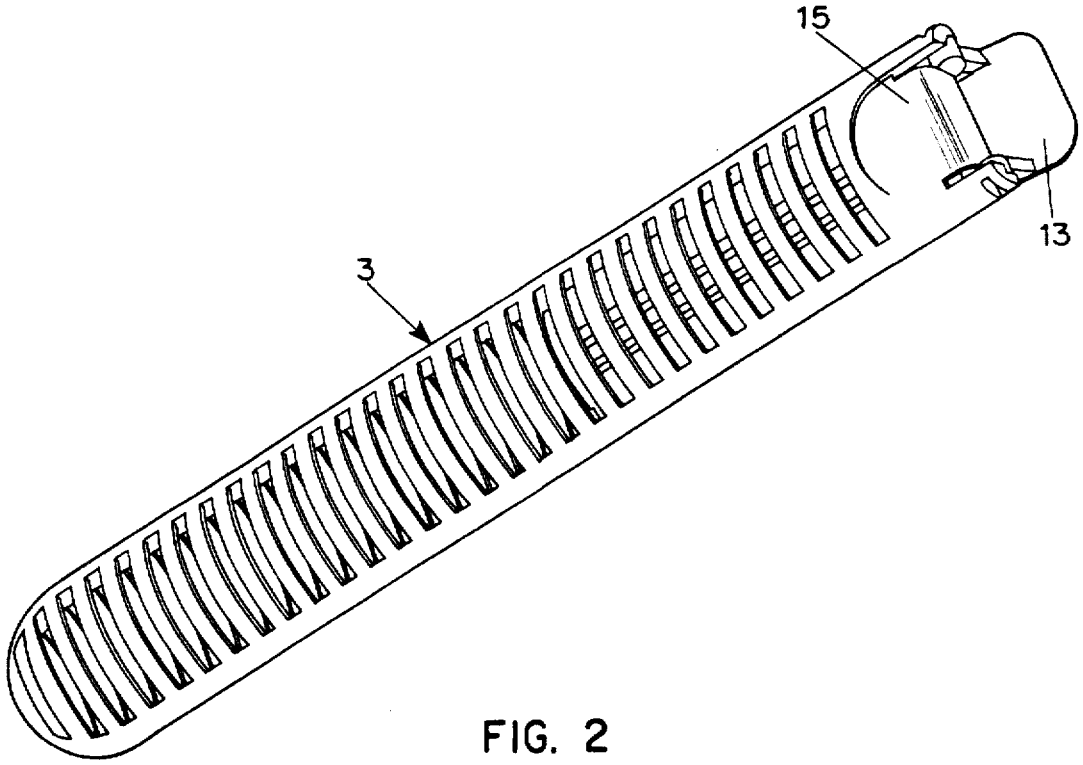
FIG. 2 is a back view of a razor in accordance with the invention.

As best seen in FIG. 2, the handle 3 includes a recess 15 on one side of the handle for receiving and engaging lip 13. The recess 11 is contoured to mate with lip 13.

Figure 3:
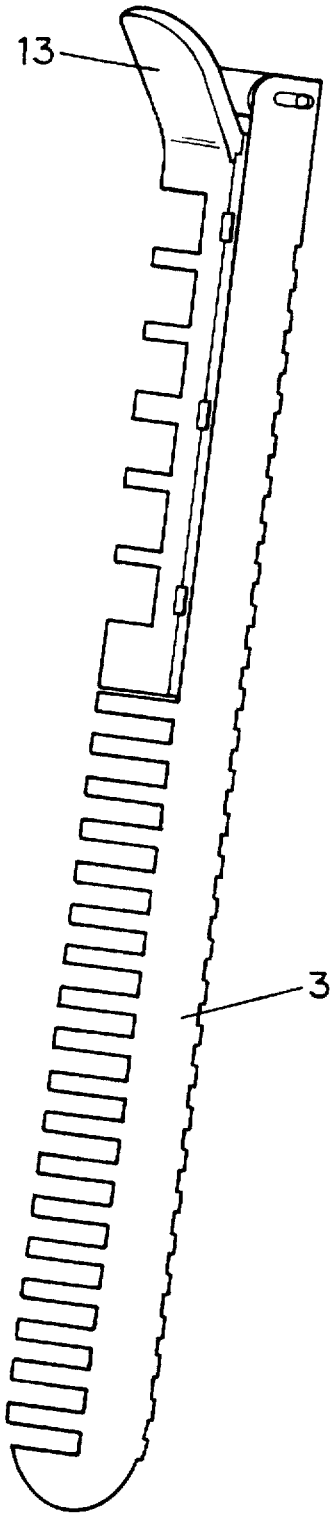
FIG. 3 is a side view of a razor in accordance with the invention.

As illustrated in FIG. 3, the lip portion 13 axially extends above the top end of the handle 3 at angle of up to 45 degrees from the shaving head 9. The application of force to lip 13 causes the shaving head 9 to pivot in an upwardly directed motion from recess 11 to an extended position in readiness for shaving.

Figure 4:
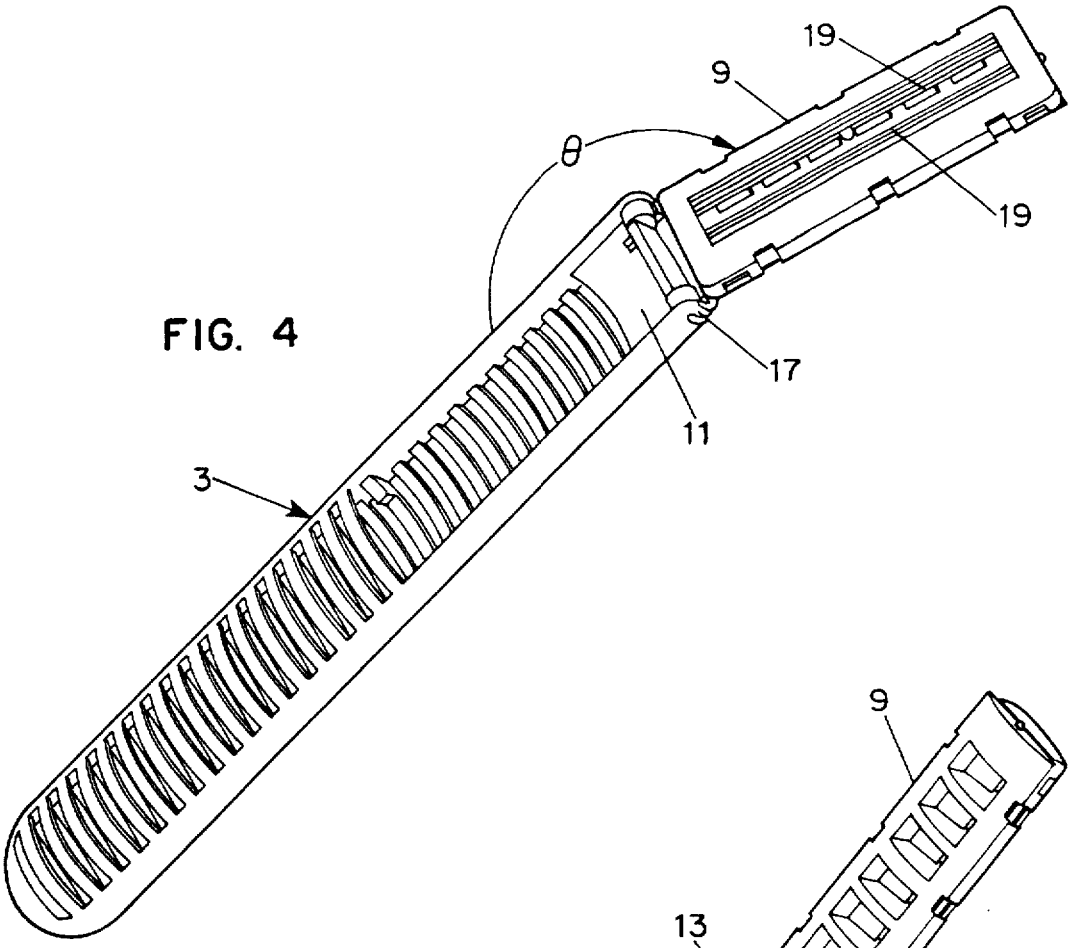
FIG. 4 is a front view of a razor in an unfolded position in accordance with the invention.
Figure 5:
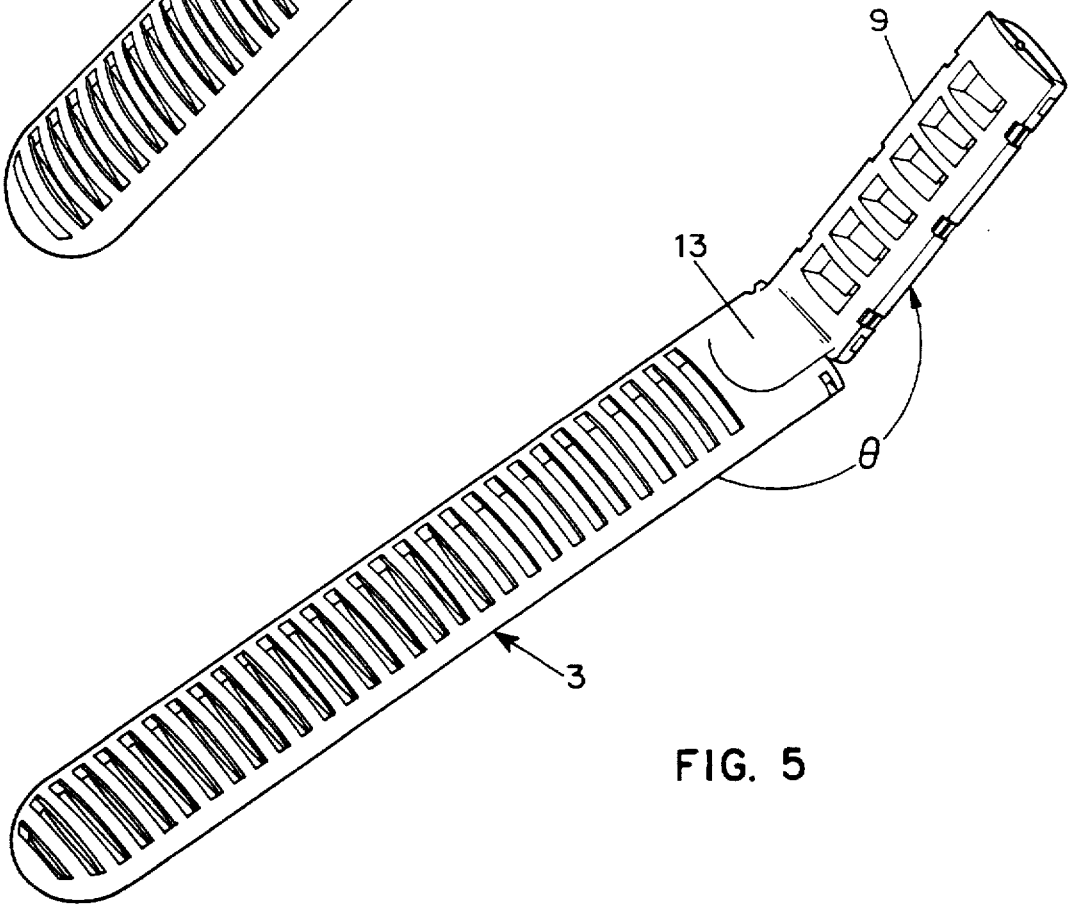
FIG. 5 is a back view of a razor in an unfolded position in accordance with the invention.

A razor in accordance with the invention in an extended or unfolded position is shown in FIG. 4. The shaving head 9 is pivotally connected to the handle 3 through a hinge 17 at the top portion of handle 3 and includes blade cartridge 12. The shaving head 9 can pivot about an angle θ of up to 270 degrees, preferably up to 225 degrees from its folded position. As can be seen from FIG. 5, the lip 13 is securely engaged in recess 11 in the razor handle when the razor is in the unfolded or extended position.

Figure 6:
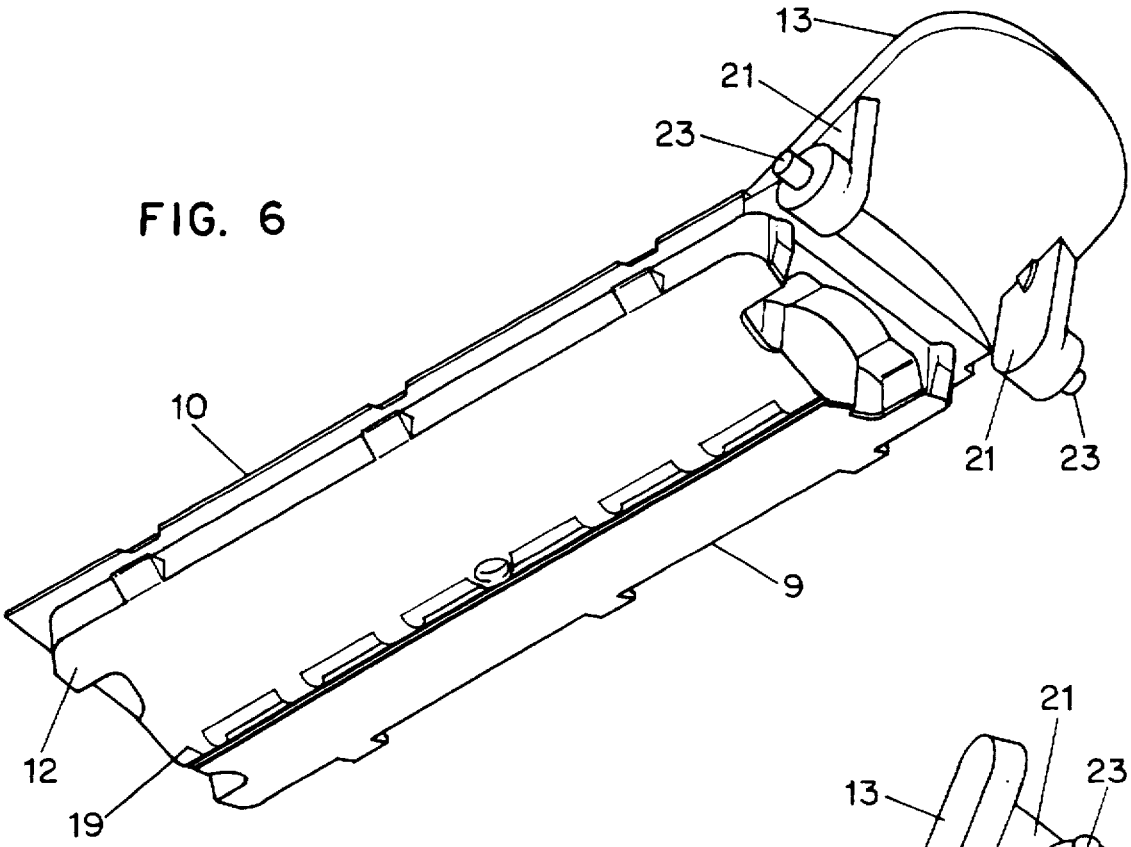
FIG. 6 is an exploded view of the top portion of the razor shown in FIG. 2.
Figure 7:
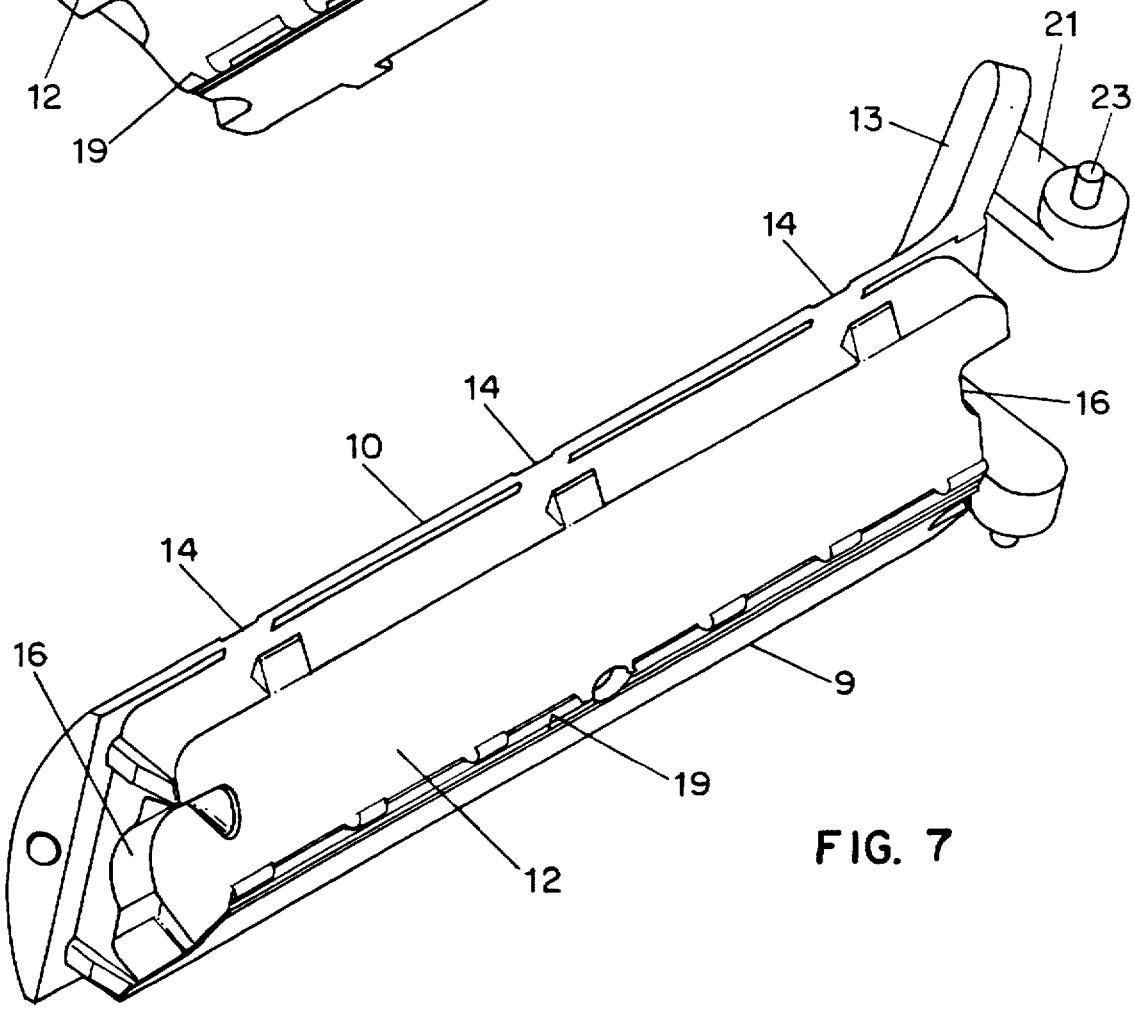
FIG. 7 is a top view of a razor handle in accordance with the invention.

The shaving head shown in FIGS. 6 and 7 includes a base portion 10 upon which a blade cartridge 12 is seated. As best seen in FIG. 7, the base portion 10 may form the back of the blade cartridge 12. In this case, the blades 19 are seated directly on back portion 10. This eliminates the need for a separate back portion for the blade cartridge 12.

Figure 8:
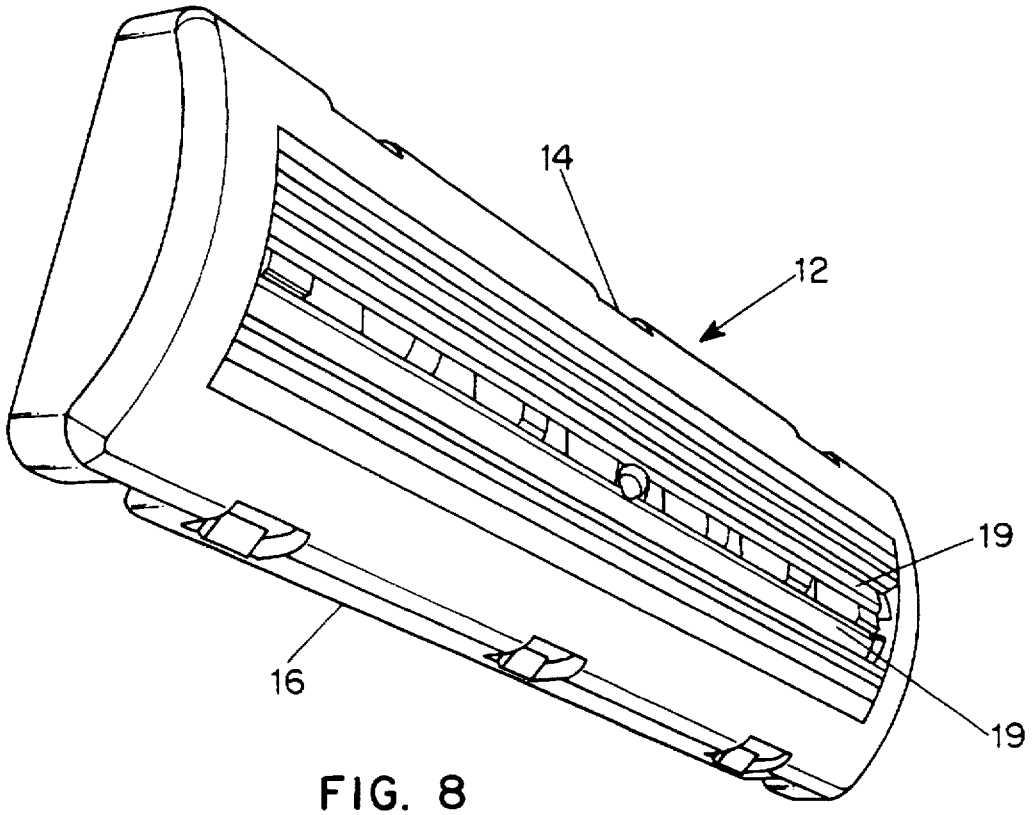
FIG. 8 is a top prospective view of a razor cartridge for use in the invention.
Figure 9:
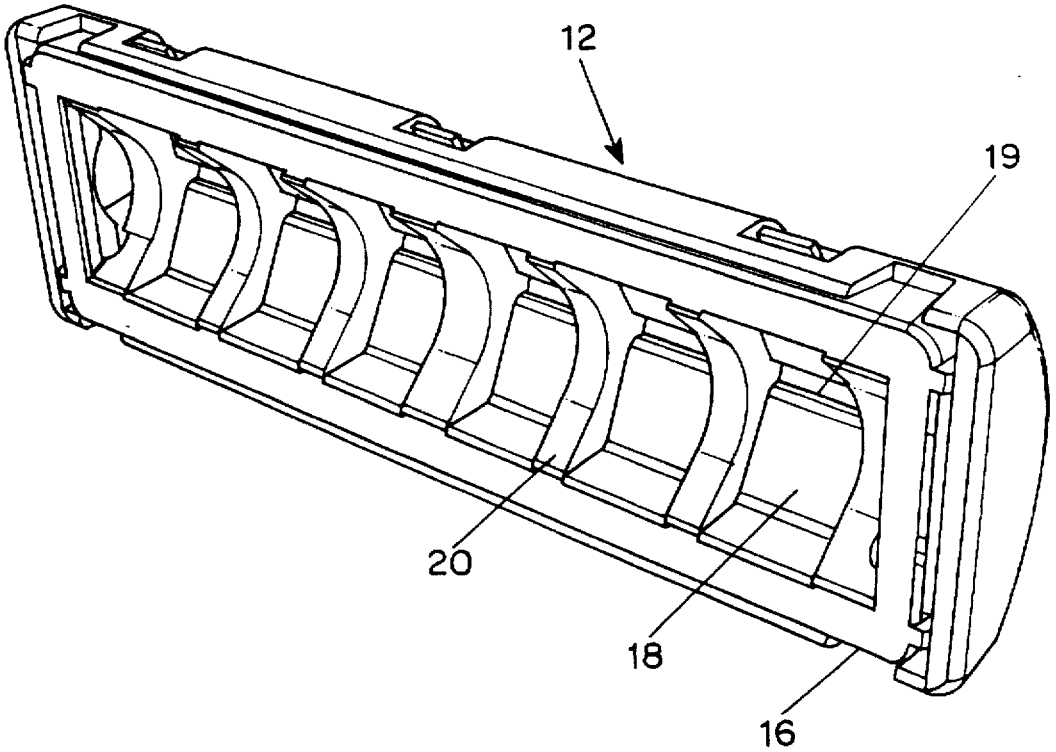
FIG. 9 is a bottom view of a razor cartridge for use in the invention.

A blade cartridge arrangement having a separate back portion is shown in FIG. 8. Typically, the blade cartridge 12 includes two razor blades 19 thereby allowing bidirectional shaving. The blade cartridge 12 also includes a blade cover 14 supporting razor blades 19. The blade cover 14 is snap fit onto a blade cartridge back portion 16 shown in FIG. 9 which has apertures 18 interspersed between solid sections 20. The apertures 18 facilitate drying of the razor blades and cartridge after wet shaving. The blade cartridge including a separate back portion may be attached to the base portion 10 by non-permanent means such as projections which snap fit into mating recesses or slide into a receiving portion of the base portion 10. Alternately, the blade cartridge including a separate back portion may be permanently attached to base portion 10 by welding, riveting or gluing.

Figure 10:
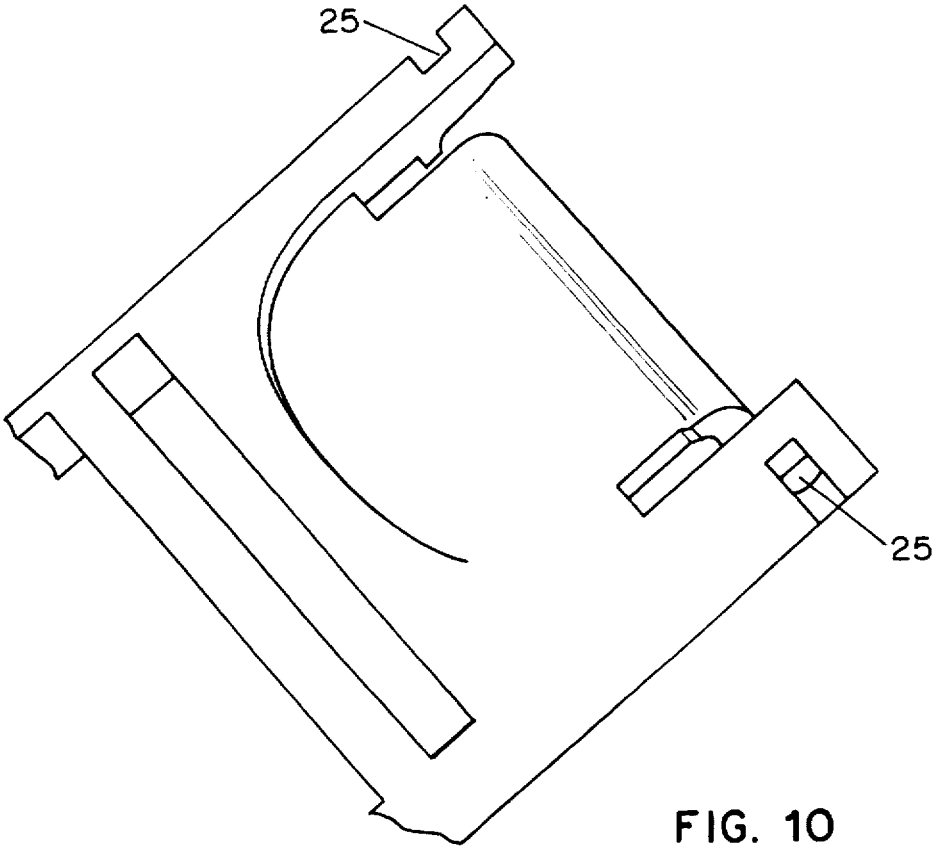
FIG. 10 is a bottom view of a shaving head in accordance with the invention.
Figure 11:
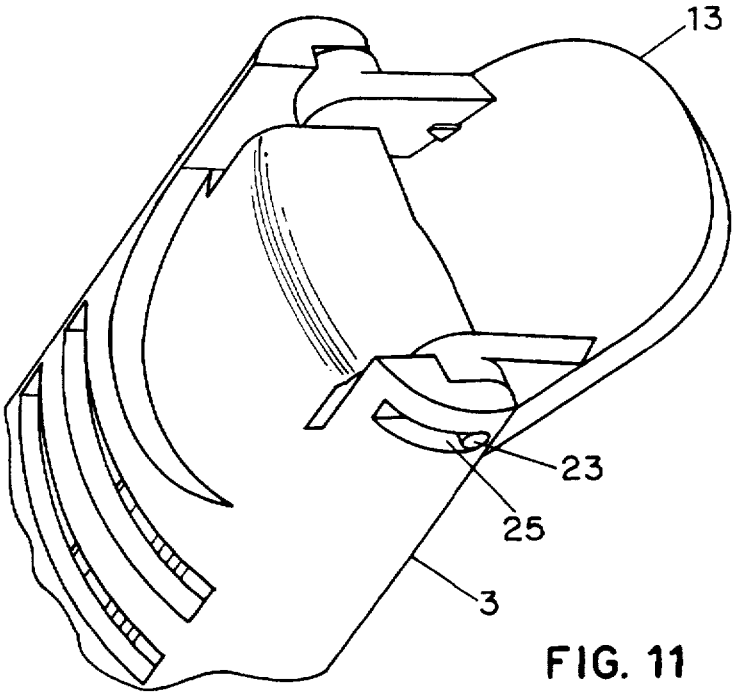
FIG. 11 is a bottom perspective view of a shaving head in accordance with the invention.

The shaving head of the present invention is pivotally connected to the razor handle. As shown in FIG. 10, projection 13 of the shaving head 9 includes two arms 21 having circular projecting pins 23. The pins 23 are snap fit into slots 25 on handle 3 thereby securing the shaving head to the handle as shown in FIG. 11. The pins 23 are rotatable in slots 25 allowing the shaving head to pivot about the razor handle.

Figure 12A:
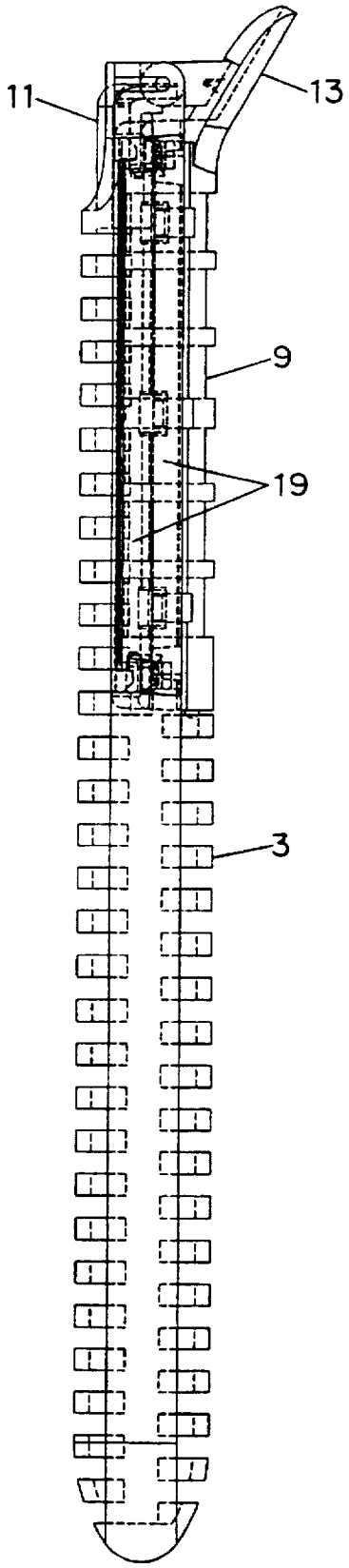
FIGS. 12(*a*) and (*b*) are graphical illustrations of a sectional side view and side view, respectively, of a razor in accordance with the invention.
Figure 12B:
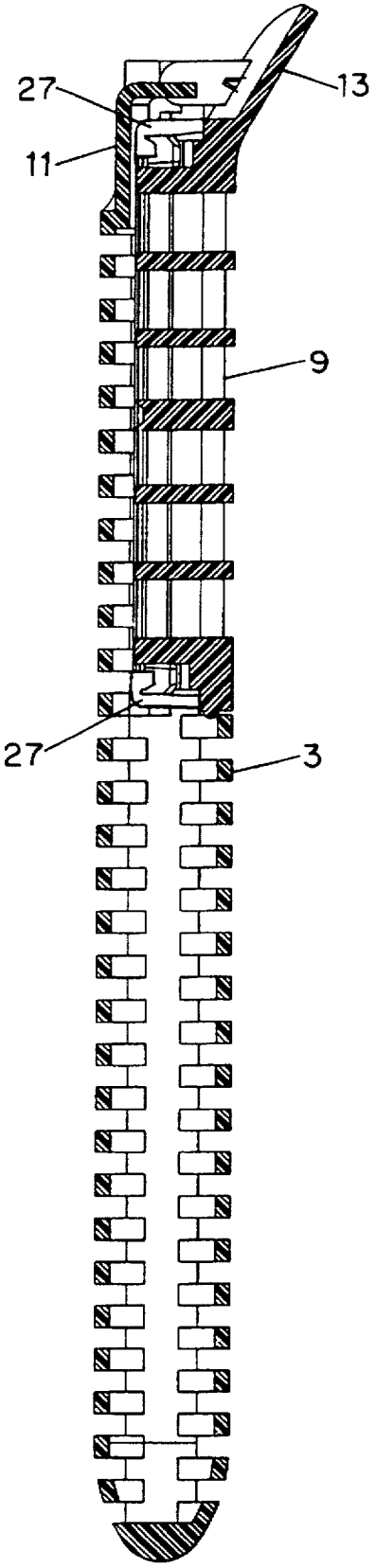

As shown in FIGS. 12(*a*) and (*b*) a locking catch 27 mates with recesses 16 in the shaving head shown in FIG. 7 and keeps the razor in a closed position when not in use.

Unlike conventional razors, the shaving head, rather than being placed perpendicular to the razor handle is aligned with it. In the open position, the shaving head is angled back allowing for a natural shaving motion whereby the hand moves in a side to side direction. The angle between the shaving head and razor handle is preferably less than 90 degrees, most preferably up to 45 degrees. The bidirectional shaving head allows the user to shave with much greater speed.

The razor handle may be molded in one piece in a two-part molding tool from polystyrene or other suitable materials. The shaving head base portion is made from the same material as the handle and is also made by injection molding. A previously assembled blade cartridge including shaving blades is then attached to the base portion 10 of the shaving head by either non-permanent or permanent means. The blade cover and back portion may also be molded from polystyrene or other suitable materials.

In an alternate method of preparing the razor, the base portion 10 forms the back of the blade cartridge. In that case, the blade cover and base portion 10 are separately formed by injection molding. Razor blades are then directly seated on the back portion 10. The blade cover is thereafter snap fit onto the base portion on which the razor blades are seated.

After the shaving head is assembled it is pivotally connected to the razor handle by snap fitting circular projecting pins 23 into recesses 25.

Although the invention has been described herein with respect to specific embodiments, many modifications and variations therein will readily occur to those skilled in the art. Accordingly, all such variations and modifications are included within the intended scope of the invention. For example, the razor described herein according to the invention may be disposable or a standard system razor for permanent or semipermanent use.

I claim:

1. A razor comprising:

a hollow handle having a bottom end, a top end and two sides, the handle including a plurality of axially spaced apertures along each side of the handle, a first recess for receiving a shaving head on one side of the handle, a second recess for receiving a lip portion of the shaving head on the opposite side of the handle, a pivot means located at the top end of the handle, and a shaving head pivotally attached to the pivot means, the shaving head including a lip portion extending axially above the pivot means, wherein applying force to the lip portion causes the shaving head to pivot about the pivot means and engages the lip portion in the second recess.

2. A razor according to claim 1 wherein the axially spaced apertures on one side of the handle are axially displaced with respect to the axially spaced apertures on the opposite side of the handle.

3. A method of making a razor comprising the steps of:

forming a hollow handle having a bottom end, a top end and two sides, the handle including a plurality of axially spaced apertures along each side of the handle, a first recess for receiving a shaving head on one side of the handle, a second recess for receiving a lip portion of the shaving head on the opposite side of the handle, a pivot means located at the top end of the handle, and pivotally attaching a shaving head to the pivot means, the shaving head including a lip portion extending axially above the pivot means, wherein applying force to the lip portion causes the shaving head to pivot about the pivot means and engages the lip portion in the second recess.

4. A method according to claim 3 wherein the axially spaced apertures on one side of the handle are axially displaced with respect to the axially spaced apertures on the opposite side of the handle.

5. A method according to claim 3 or claim 4 comprising injection molding the hollow handle and injection molding the shaving head.

* * * * *